US007315198B2

(12) United States Patent
Park et al.

(10) Patent No.: US 7,315,198 B2
(45) Date of Patent: Jan. 1, 2008

(54) VOLTAGE REGULATOR

(75) Inventors: Jin-Sung Park, Gyeonggi-do (KR); Dae-Seok Byeon, Gyeonggi-do (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 180 days.

(21) Appl. No.: 11/167,983

(22) Filed: Jun. 27, 2005

(65) Prior Publication Data

US 2006/0082411 A1 Apr. 20, 2006

(30) Foreign Application Priority Data

Oct. 20, 2004 (KR) ..... 10-2004-0084057

(51) Int. Cl.
*G05F 1/575* (2006.01)
*G05F 1/56* (2006.01)

(52) U.S. Cl. ..... 327/541; 327/544; 323/314

(58) Field of Classification Search ..... None
See application file for complete search history.

(56) References Cited

U.S. PATENT DOCUMENTS

| | | | | |
|---|---|---|---|---|
| 6,373,754 | B1 * | 4/2002 | Bae et al. | 365/189.09 |
| 6,442,079 | B2 | 8/2002 | Lee et al. | 365/189.09 |
| 6,650,175 | B2 * | 11/2003 | Messager | 327/541 |
| 6,940,336 | B2 * | 9/2005 | Bakker | 327/541 |
| 7,049,881 | B2 * | 5/2006 | Moon et al. | 327/541 |
| 7,183,838 | B2 * | 2/2007 | Iwase | 327/541 |
| 2005/0073356 | A1 * | 4/2005 | Won | 327/541 |
| 2006/0164060 | A1 * | 7/2006 | Itoh | 323/313 |

FOREIGN PATENT DOCUMENTS

| | | |
|---|---|---|
| JP | 2000-243096 | 9/2000 |
| KR | 2002-0018866 | 3/2002 |
| KR | 10-0362700 | 11/2002 |
| KR | 2003-0094568 | 12/2003 |
| KR | 2004-0023187 | 3/2004 |

OTHER PUBLICATIONS

English language abstract of Korean Publication No. 2001-0077519.

English language abstract of Japanese Publication No. 2000-243096.

English language abstract of Korean Publication No. 2002-0018866.

English language abstract of Korean Publication No. 2003-0094568.

English language abstract of Korean Publication No. 2004-0023187.

* cited by examiner

*Primary Examiner*—Kenneth B. Wells
*Assistant Examiner*—Terry L. Englund
(74) *Attorney, Agent, or Firm*—Marger Johnson & McCollom, P.C.

(57) ABSTRACT

Disclosed is a voltage regulator capable of reducing a set-up time. A driver is connected between a power supply terminal and the output terminal, and supplies a power supply voltage to the output terminal in response to a signal of a control node. A first signal generator provides a first signal to the control node when a voltage of the output terminal is lower than the target voltage. A second signal generator provides a second signal to the control node for a predetermined period of time when the voltage of the output terminal becomes higher than a detection voltage while the first signal generator is providing the first signal to the control node.

19 Claims, 3 Drawing Sheets

VOLTAGE REGULATOR

CROSS-REFERENCE TO RELATED APPLICATIONS

This U.S. non-provisional patent application claims priority and benefit from Korean Patent Application No. 2004-84057 filed on Oct. 20, 2004, the entire contents of which are hereby incorporated by reference.

BACKGROUND OF THE INVENTION

The invention relates to a semiconductor memory device and, more particularly, to a voltage regulator for a semiconductor memory device.

Semiconductor memory devices are storage devices that contain data therein and read out the stored data therefrom. Semiconductor memory devices are generally classified into random access memory (RAM) and read only memory (ROM). RAM is a volatile memory device that loses data stored in its memory cells when electrical power supplied to the device is interrupted or suspended. ROM is a nonvolatile memory device that retains data in its memory cell even when the electrical power supplied to the device is shut down. ROM includes various kinds such as a programmable ROM (PROM), an erasable PROM (EPROM), an electrically EPROM (EEPROM), and a flash memory device.

The semiconductor memory device includes a voltage regulator to supply a target voltage of a constant level into an internal circuit. For example, Korean Patent No. 10-0362700 (U.S. Pat. No. 6,442,079, issued to Byeong-Hoon Lee, et al. on Aug. 27, 2002) discloses a voltage regulator for nonvolatile storage devices of an electrically erasable and programmable semiconductor type. As generally known in the prior art such as the aforementioned U.S. patent, a conventional regulator includes a comparator, a PMOS transistor used as a driver, and resistors used as a voltage dividing circuit. The comparator is composed of a differential amplifier and discriminates whether an output voltage of the voltage dividing circuit is lower than a reference voltage. The PMOS transistor operates according to the discriminated result of the comparator. For example, when an output voltage of the voltage regulator is lower than a target voltage, the comparator turns on the PMOS transistor, causing an increase of an output voltage level. In contrast, when the output voltage of the voltage regulator is higher than the target voltage, the comparator turns off the PMOS transistor, causing a decrease of the output voltage level.

However, in the conventional voltage regulator, it takes a long time for the output voltage to reach the target voltage. Particularly, when the target voltage is lower than 1 V, a significant problem occurs. When the target voltage is lower than 1 V, the reference voltage also becomes lower than 1 V. At this time, the reference voltage can become almost identical with a threshold voltage of an NMOS transistor in a differential amplifier. When the reference voltage becomes almost identical with the threshold voltage of an NMOS transistor, the time required that the comparator discharges a gate of a PMOS transistor is increased. Accordingly, the PMOS transistor is turned on later, resulting in an increased setup time of the target voltage.

SUMMARY OF THE INVENTION

The invention is directed to a voltage regulator that reduces a set-up time.

An aspect of the invention is to provide a voltage regulator for supplying a target voltage through an output terminal, the voltage regulator comprising: a driver connected between a power supply terminal and the output terminal for supplying a power supply voltage to the output terminal in response to a signal of a control node; a first signal generator for providing a first signal to the control node when a voltage of the output terminal is lower than the target voltage; and a second signal generator for providing a second signal to the control node for a predetermined period of time when the voltage of the output terminal becomes higher than a detection voltage while the first signal generator is providing the first signal to the control node.

In the embodiment, the first signal generator operates in response to a regulator enable signal. The second signal generator operates in response to a detection enable signal, and the detection enable signal is generated by delaying the regulator enable signal for a predetermined period of time.

In the embodiment, the driver is a PMOS transistor that includes a source connected to the power supply terminal, a drain connected to the output terminal, and a gate connected to the control node.

In the embodiment, the first signal generator includes: a voltage dividing circuit for dividing the voltage of the output terminal; a comparator operating in response to a regulator enable signal for generating the first signal when the divided voltage from the voltage dividing circuit is lower than a reference voltage.

In the embodiment, the second signal generator includes: a voltage dividing circuit for dividing the voltage of the output terminal; a switch for electrically connecting the voltage dividing circuit to the output terminal in response to a detection enable signal; a level detector for generating a driving signal when the divided voltage from the voltage dividing circuit is higher than the detection voltage; and a pulse generator for receiving the driving signal from the level detector and providing the second signal having a predetermined pulse width to the control node. Here, the predetermined pulse width corresponds to the predetermined time period.

According to another aspect of the invention, there is provided a voltage regulator for supplying a target voltage through an output terminal, the voltage regulator comprising: a PMOS transistor including a source connected to a power supply terminal, a drain connected to the output terminal, and a gate connected to a control node; a first signal generator for providing a first signal to the control node when a voltage of the output terminal is lower than the target voltage; a second signal generator for generating a second signal having a predetermined pulse width when the voltage of the output terminal is higher than a detecting voltage while the first signal generator is providing the first signal to the control node; and a discharge circuit for discharging the control node in response to the second signal from the second signal generator.

In the embodiment, the first signal generator operates in response to a regulator enable signal. Preferably, the second signal generator operates in response to a detection enable signal, and the detection enable signal is generated by delaying the regulator enable signal for a predetermined period of time.

In the embodiment, the first signal generator includes: a voltage dividing circuit for dividing the voltage of the output terminal; a comparator operating in response to a regulator enable signal for providing the first signal when the divided voltage of the voltage dividing circuit is lower than a reference voltage.

In the embodiment, the second signal generator includes: a voltage dividing circuit for dividing the voltage of the output terminal; a switch for electrically connecting the voltage dividing circuit to the output terminal in response to a detection enable signal; a level detector for generating a driving voltage when the divided voltage from the voltage dividing circuit becomes higher than a detection voltage; and a pulse generator for receiving the driving signal from the level detector and providing the second signal having a predetermined pulse width to the control node. Here, the switch includes a pass transistor.

In the embodiment, the discharge circuit is an NMOS transistor that includes a drain connected to the control node, a gate connected to the pulse generator, and a source connected to a ground terminal.

The voltage regulator according to the invention can obtain a target voltage of a constant level at a reduced setup time.

BRIEF DESCRIPTION OF THE DRAWINGS

The above and other features and advantages of embodiments of the invention will become readily apparent by reference to the following detailed description when considered in conjunction with the accompanying drawings.

DETAILED DESCRIPTION OF PREFERRED EMBODIMENTS

The invention will be described below with reference to the accompanying drawings in which an exemplary embodiment of the invention is shown. The invention may, however, be embodied in many different forms and should not be constructed as limited to the embodiment set forth herein. Rather, this embodiment is provided so that this disclosure will be thorough and complete, and will fully convey the scope of the invention to those skilled in the art. Like numerals refer to like elements throughout the specification.

Figure 1:
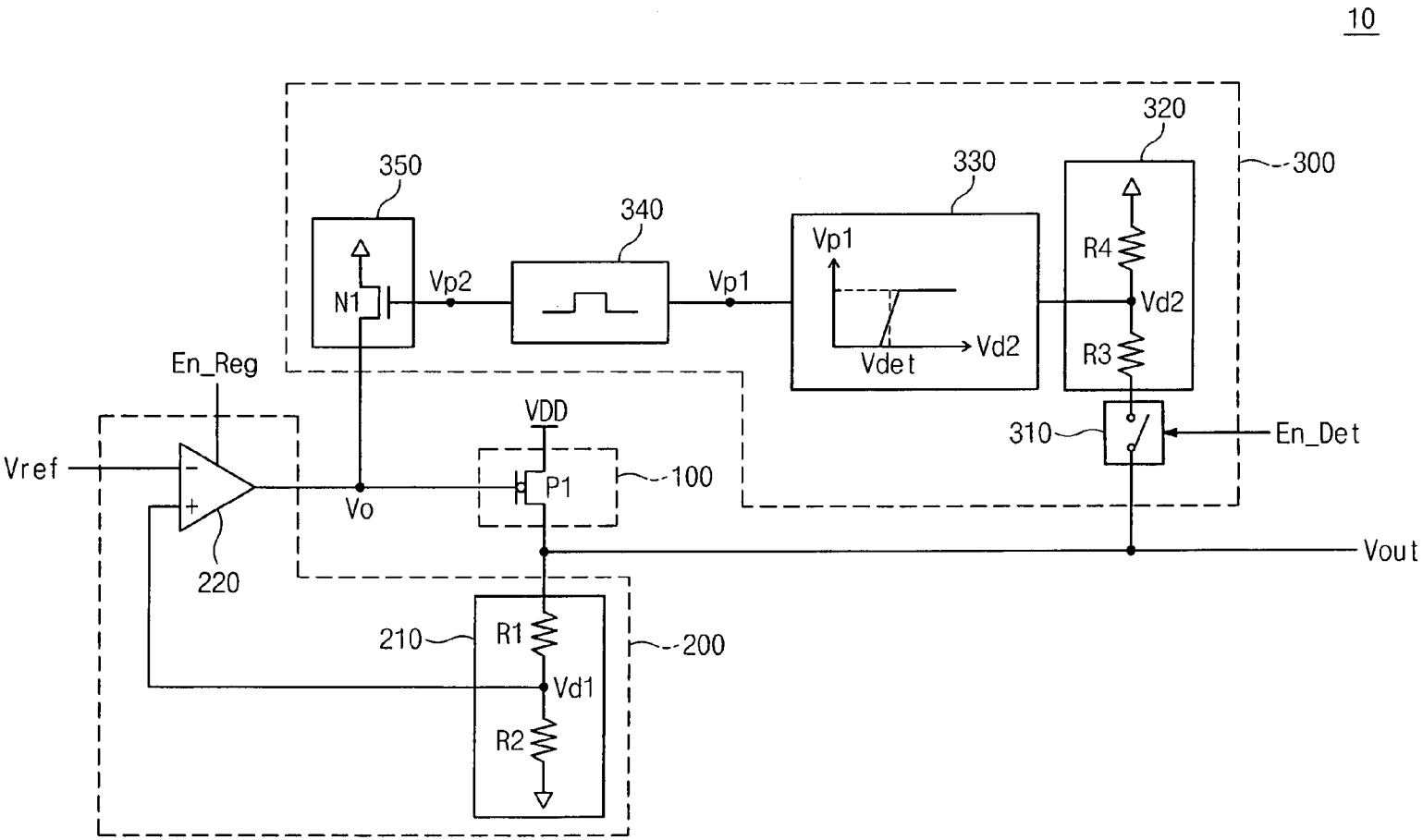
FIG. 1 is a circuit diagram illustrating a voltage regulator for a semiconductor memory device according to a preferred embodiment of the invention.

FIG. 1 is a circuit diagram showing a voltage regulator 10 for a semiconductor memory device according to a preferred embodiment of the invention. The voltage regulator 10 according to the invention supplies a target voltage of a constant level to an internal circuit (not shown) of a semiconductor memory device through an output terminal. Referring to FIG. 1, the voltage regulator 10 includes a driver 100, a first signal generator 200, and a second signal generator 300.

The driver 100 is connected between a power supply terminal and the output terminal Vout. The driver 100 supplies a power supply voltage VDD to the output terminal Vout in response to a signal Vo inputted to a control node. The driver 100 includes a PMOS transistor P1 that has a source connected to the power supply terminal, a drain connected to the output terminal Vout, and a gate connected to the control node.

The first signal generator 200 operates in response to a regulator enable signal En_Reg and provides a first signal to the control node when a voltage of the output terminal Vout is lower than the target voltage. The first signal generator 200 includes a voltage dividing circuit 210 and a comparator 220.

The voltage dividing circuit 210 is connected between the output terminal Vout and a ground terminal. The voltage dividing circuit 210 is composed of two resistors R1 and R2 that are serially connected to each other. The voltage dividing circuit 210 divides the voltage of the output terminal Vout and generates a divided voltage Vd1 at a connection node of the two resistors R1 and R2. The divided voltage Vd1 is provided to the comparator 220.

The comparator 220 operates in response to the regulator enable signal En_Reg and generates a first signal of a low level when the divided voltage Vd1 of the voltage dividing circuit 210 is lower than a reference voltage Vref. The reference voltage generator receives an external voltage and generates and provides the reference voltage Vref to the comparator 220.

The second signal generator 300 operates in response to a detection enable signal En_Det and provides a second signal to the control node for a predetermined time period when the voltage of the output terminal Vout is higher than a detection voltage Vdet while the first signal generator 200 is providing the first signal to the control node. Preferably, the detection enable signal En_Det is generated when a predetermined time elapses after the regulator enable signal En_Reg is generated. More preferably, the detection voltage is lower than the target voltage. The second signal generator 300 includes a switch 310, a voltage dividing circuit 320, a level detector 330, a pulse generator 340, and a discharge circuit 350.

Figure 3:
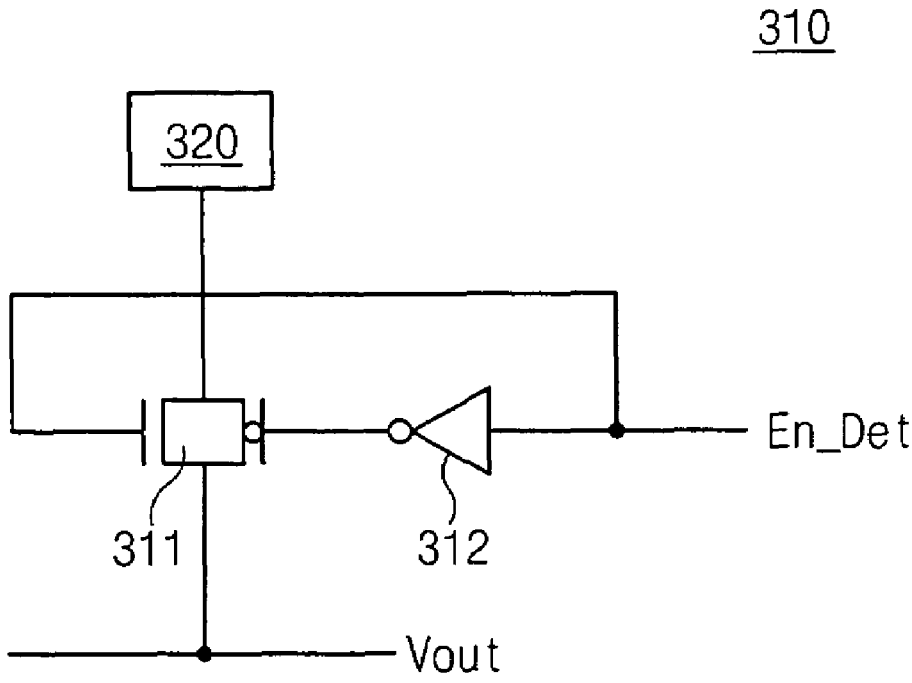
FIG. 3 is a circuit diagram illustrating a switch shown in FIG. 1.

The switch 310 electrically connects the voltage dividing circuit 320 to the output terminal Vout in response to a detection enable signal En_Det from a delay circuit (not shown). A delay circuit delays the regulator enable signal for a predetermined period of time and generates the detection enable signal En_Det as a delayed signal. FIG. 3 is a circuit diagram showing a switch 310 shown in FIG. 1. With reference to FIG. 3, the switch 310 includes a pass transistor 311 and an inverter 312. When the detection enable signal En_Det is activated, the pass transistor 311 electrically connects the voltage dividing circuit 320 to the output terminal Vout.

The voltage dividing circuit 320 is connected between the switch 310 and a ground terminal. The voltage dividing circuit 320 includes two resistors R3 and R4 that are serially connected to each other. The voltage dividing circuit 320 divides the voltage of the output terminal Vout, and generates a divided voltage Vd2 at a connection node of the resistors R3 and R4. The divided voltage Vd2 is provided to the level detector 330.

The level detector 330 generates a driving signal Vp1 when the divided voltage Vd2 from the voltage dividing circuit 320 becomes higher than a set detection voltage Vdet. The pulse generator 340 receives the driving signal Vp1 from the level detector 330, and generates a pulse signal Vp2 having a predetermined pulse width to the control node. The pulse signal Vp2 is provided to a discharge circuit 350.

The discharge circuit 350 discharges the control node in response to the pulse signal Vp2. Referring to FIG. 1, the discharge circuit 350 is composed of an NMOS transistor N1. The NMOS transistor N1 includes a drain connected to the control node, a gate connected to the pulse generator 340, and a source connected to a ground terminal.

Figure 2:
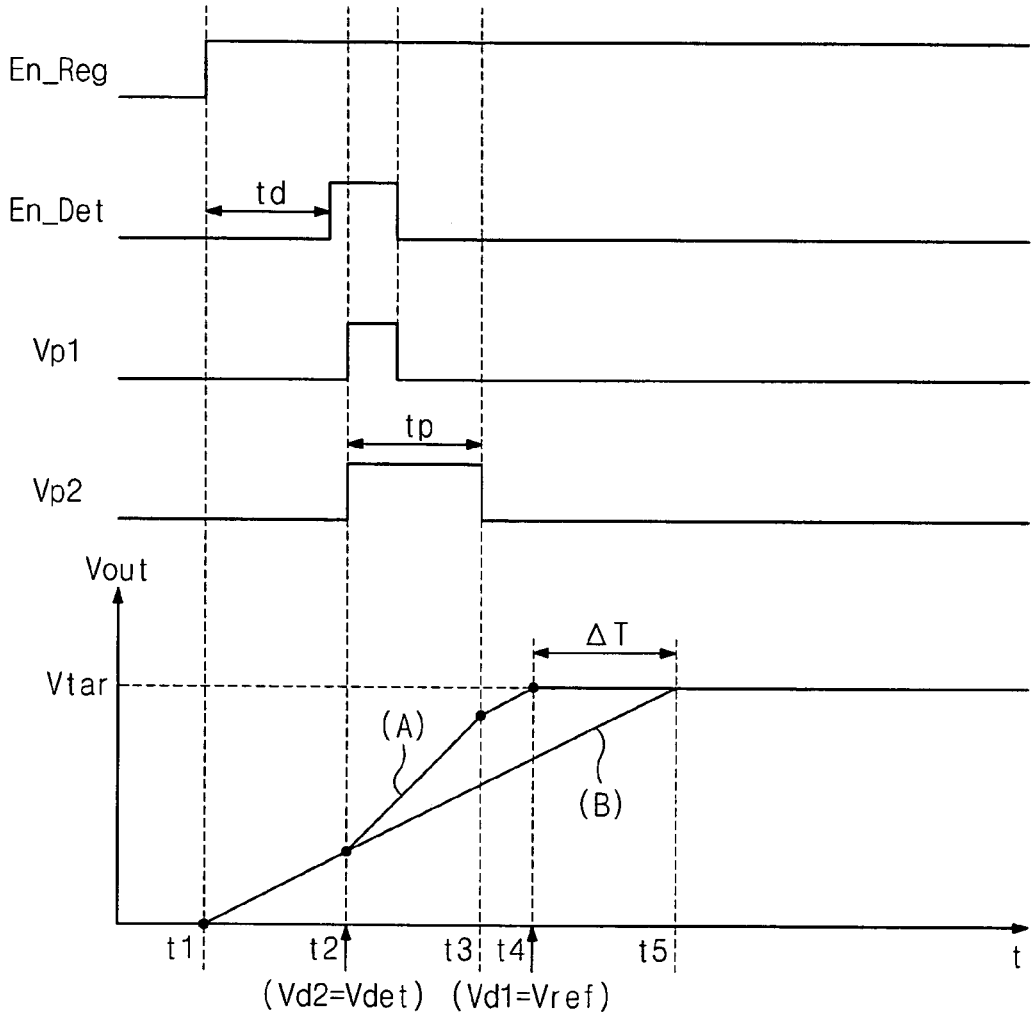
FIG. 2 is a timing chart illustrating an operation of the voltage regulator shown in FIG. 1.

FIG. 2 is a timing chart that illustrates an operation of the voltage regulator 10 shown in FIG. 1. The operation of the voltage regulator 10 will be described with reference to FIGS. 1 and 2.

At time t1, when the regulator enable signal En_Reg is activated, an output voltage Vout gradually starts to increase to a target voltage Vtar. After a predetermined delay time period td elapses, the detection enable signal En_Det is activated. According to the activation of the detection enable signal En_Det, the switch 310 is turned on. At this time, an output voltage Vout is voltage-divided by the voltage dividing circuit 320. As the output voltage Vout increases, the divided voltage Vd2 also increases.

At time t2, when the divided voltage Vd2 reaches the detection voltage Vdet, the level detector 330 generates a driving signal Vp1. In response to an inactivation of the detection enable signal En_Det, the driving signal Vp1 is inactivated. The pulse generator 340 generates a pulse signal Vp2 having a predetermined pulse width tp responsive to the driving signal Vp1 from the level detector 330. The discharge circuit 350 discharges a control node of the driver 100 in response to pulse signal Vp2 from the pulse generator 340. At this time, the output voltage Vout is rapidly increased. As shown in FIG. 2, during an interval of t2~t3, the output voltage Vout is rapidly increased like (A).

At time t3, according to an inactivation of the pulse signal Vp2, the discharge circuit 350 is turned off. At this time, the output voltage Vout is gradually increased by a first signal from the first signal generator 200.

At time t4, when the output voltage Vout reaches the target voltage Vtar, the output voltage Vout stops increasing and maintains the target voltage Vtar. At time t4, the divided voltage Vd1 reaches a reference voltage Vref.

With reference to FIG. 1, if the voltage regulator 10 does not activate the second signal generator 300, the output voltage Vout reaches the target voltage Vtar at time t5. That is, the output voltage Vout is slowly increased like (B). At time t5, the divided voltage Vd1 reaches the reference voltage Vref.

Referring to a graph showing a change of the output voltage Vout according to time t of FIG. 2, it is understood that a setup time is reduced by ΔT (=t5−t4). Namely, the voltage regulator 10 according to the invention discharges a control node of the driver 100 for a predetermined period of time while the driver 100 is being driven by the first signal generator 200. The voltage regulator 10 reduces the setup time, thereby obtaining the target voltage Vtar within a shorter time.

Although the invention has been described in connection with the embodiment of the invention illustrated in the accompanying drawings, it is not limited thereto. It will be apparent to those skilled in the art that various substitutions, modifications and changes may be thereto without departing from the scope and spirit of the invention as defined by the appended claims.

What is claimed is:

1. A voltage regulator for supplying a target voltage, comprising:

a driver connected between a power supply terminal and an output terminal, for supplying a power supply voltage to the output terminal in response to a first signal or a second signal of a control node;

a first signal generator for providing the first signal to the control node when a voltage of the output terminal is lower than the target voltage; and a second signal generator for providing the second signal to the control node for a predetermined period of time when the voltage of the output terminal becomes higher than a detection voltage while the first signal generator is providing the first signal to the control node.

2. The voltage regulator as set forth in claim 1, wherein the first signal generator operates in response to a regulator enable signal.

3. The voltage regulator as set forth in claim 2, wherein the second signal generator operates in response to a detection enable signal, and the detection enable signal is generated by delaying the regulator enable signal for a predetermined delay period.

4. The voltage regulator as set forth in claim 1, wherein the detection voltage is lower than the target voltage.

5. The voltage regulator as set forth in claim 1, wherein the driver is a PMOS transistor comprising a source connected to the power supply terminal, a drain connected to the output terminal, and a gate connected to the control node.

6. The voltage regulator as set forth in claim 1, wherein the first signal generator comprises:

a voltage dividing circuit for dividing the voltage of the output terminal; and a comparator for operating in response to a regulator enable signal for generating the first signal when the divided voltage from the voltage dividing circuit is lower than a reference voltage.

7. The voltage regulator as set forth in claim 1, wherein the second signal generator comprises:

a voltage dividing circuit for dividing the voltage of the output terminal;

a switch electrically connecting the voltage dividing circuit to the output terminal in response to a detection enable signal;

a level detector for generating a driving signal when the divided voltage from the voltage dividing circuit becomes higher than the detection voltage; and a pulse generator for receiving the driving signal from the level detector and for providing the second signal having a predetermined pulse width to the control node.

8. The voltage regulator as set forth in claim 7, wherein the predetermined pulse width corresponds to the predetermined period of time.

9. A voltage regulator for supplying a target voltage to an output terminal, the voltage regulator comprising:

a PMOS transistor comprising a source connected to a power supply terminal, a drain connected to the output terminal, and a gate connected to a control node;

a first signal generator for providing a first signal to the control node when a voltage of the output terminal is lower than the target voltage;

a second signal generator for generating a second signal having a predetermined pulse width when the voltage of the output terminal is higher than a detecting voltage while the first signal generator is providing the first signal to the control node; and a discharge circuit for discharging the control node in response to the second signal from the second signal generator.

10. The voltage regulator as set forth in claim 9, wherein the first signal generator operates in response to a regulator enable signal.

11. The voltage regulator as set forth in claim 10, wherein the second signal generator operates in response to a detection enable signal, and the detection enable signal is generated by delaying the regulator enable signal for a predetermined period of time.

12. The voltage regulator as set forth in claim 9, wherein the first signal generator comprises:

a voltage dividing circuit for dividing the voltage of the output terminal; and a comparator for operating in response to a regulator enable signal for providing the first signal when the divided voltage of the voltage dividing circuit is lower than a reference voltage.

13. The voltage regulator as set forth in claim 9, wherein the second signal generator comprises:

a voltage dividing circuit for dividing the voltage of the output terminal;

a switch electrically connecting the voltage dividing circuit to the output terminal in response to a detection enable signal;

a level detector for generating a driving voltage when the divided voltage from the voltage dividing circuit becomes higher than the detecting voltage; and a pulse generator for receiving the driving signal from the level detector and for providing the second signal having the predetermined pulse width to the discharge circuit.

14. The voltage regulator as set forth in claim 13, wherein the switch includes a pass transistor.

15. The voltage regulator as set forth in claim 9, wherein the discharge circuit is an NMOS transistor that includes a drain connected to the control node, a gate connected to the second signal generator, and a source connected to a ground terminal.

16. A method for supplying a target voltage, comprising:

driving a power supply voltage to an output terminal in response to a first or a second signal of a control node;

providing the first signal to the control node when a voltage of the output terminal is lower than a target voltage; and providing the second signal to the control node for a predetermined period of time when the voltage of the output terminal becomes higher than a detection voltage while the first signal is provided to the control node.

17. The method as set forth in claim 16, wherein providing the first signal comprises:

dividing the voltage of the output terminal; and generating the first signal when the divided voltage is lower than a reference voltage.

18. The method as set forth in claim 16, wherein providing the second signal comprises:

dividing the voltage of the output terminal;

generating the second signal when the divided voltage becomes higher than the detection voltage, the second signal having a predetermined pulse width; and providing the second signal to the control node.

19. The method as set forth in claim 18, wherein the predetermined pulse width corresponds to the predetermined period of time.

* * * * *